US010907825B2

(12) United States Patent
Polleunis

(10) Patent No.: US 10,907,825 B2
(45) Date of Patent: Feb. 2, 2021

(54) GAS BURNER FOR STRONG AIR FLOW

(71) Applicant: AGROFROST, NAAMLOZE VENNOOTSCHAP, Brussels (BE)

(72) Inventor: Marc Polleunis, Kortenaken (BE)

(73) Assignee: AGROFROST, NAAMLOZE VENNOOTSCHAP, Brussels (BE)

( * ) Notice: Subject to any disclaimer, the term of this patent is extended or adjusted under 35 U.S.C. 154(b) by 196 days.

(21) Appl. No.: 16/323,576

(22) PCT Filed: Jul. 27, 2017

(86) PCT No.: PCT/BE2017/000035
§ 371 (c)(1),
(2) Date: Feb. 6, 2019

(87) PCT Pub. No.: WO2018/027285
PCT Pub. Date: Feb. 15, 2018

(65) Prior Publication Data

US 2019/0203932 A1 Jul. 4, 2019

(30) Foreign Application Priority Data

Aug. 8, 2016 (BE) ..... 2016/5628

(51) Int. Cl.
*F23D 14/20* (2006.01)

(52) U.S. Cl.
CPC .... *F23D 14/20* (2013.01); *F23D 2900/14041* (2013.01); *F23D 2900/14641* (2013.01); *F23D 2900/21003* (2013.01)

(58) Field of Classification Search
CPC ..... F23D 14/20; F23D 2900/14041; F23D 2900/14641; F23D 2900/21003
See application file for complete search history.

(56) References Cited

U.S. PATENT DOCUMENTS 3,830,620 A 8/1974 Martin
3,843,309 A * 10/1974 Lambiris ..... F23C 99/00 431/284

(Continued)

FOREIGN PATENT DOCUMENTS

EP 0 498 516 A2 8/1992
JP S49 122037 A 11/1974

OTHER PUBLICATIONS

International Search Report, dated Oct. 26, 2017, from corresponding PCT/BE2017/000035 application.

*Primary Examiner* — Alfred Basichas
(74) *Attorney, Agent, or Firm* — Nixon & Vanderhye

(57) ABSTRACT

A gas burner includes a burner pipe, in which gas is supplied and which is provided with a row of linearly arranged perforations that allow the gas through to a burner chamber, and an ignition mechanism to ignite the gas electrically. The burner pipe is provided on the inside with a gas distribution pipe in order to evenly distribute the gas supply over the entire row of perforations, and the burner chamber is surrounded by a premounted air chamber, which is connected to the burner chamber by means of air slots, whereby the air slots are oblique with respect to the longitudinal axis of the burner pipe at an angle between 10° and 80°, and whereby the air supply through the air slots is controlled by a device that blows in or draws in air through the premounted air chamber.

6 Claims, 3 Drawing Sheets

(56) References Cited

U.S. PATENT DOCUMENTS

| | | | | |
|---|---|---|---|---|
| 4,737,100 | A | 4/1988 | Schnell et al. | |
| 4,767,319 | A * | 8/1988 | Vosper | F23D 14/34 431/350 |
| 5,131,836 | A * | 7/1992 | Coppin | F23N 1/02 431/12 |
| 6,301,875 | B1 * | 10/2001 | Backlund | F23D 14/70 431/202 |
| 6,409,502 | B2 * | 6/2002 | Bury | F23C 6/047 431/171 |
| 6,921,261 | B2 * | 7/2005 | Perry | F23D 14/64 126/110 C |
| 6,929,470 | B1 * | 8/2005 | Lifshits | F23D 91/02 431/350 |
| 7,481,650 | B2 * | 1/2009 | Mosiewicz | F23C 6/045 126/110 B |
| 10,378,441 | B2 * | 8/2019 | Said | F23D 14/20 |
| 2005/0014103 | A1 * | 1/2005 | Perry | F23D 14/70 431/352 |
| 2010/0139650 | A1 * | 6/2010 | Pritchard | F23D 14/105 126/91 A |

* cited by examiner

GAS BURNER FOR STRONG AIR FLOW

The present invention relates to a gas burner for application in a strong air flow, which is generated by a fan or suction installation for example.

More specifically the invention is intended to obtain a gas burner that ignites in both a low and high air speed of the drawn in or blown in air without problems and guarantees optimum combustion.

It is known that for a gas burner that operates in a strong air flow, for example just before or just after a fan, to date it has been necessary to greatly reduce the air flow to be able to ignite the burner. This can be done by greatly reducing the speed of the fan or stopping it.

In applications where the burner must be frequently ignited, this is a considerable nuisance and leads to a time loss and extra operations with further complications.

As a rule a gas burner can only be ignited within a certain range of air speed because a change of air speed also changes the gas/oxygen ratio and the burner will no longer ignite if this ratio is not within certain limits. Moreover, the efficiency of the combustion depends on the air speed.

The purpose of the present invention is to provide a solution to the aforementioned and other disadvantages.

To this end the invention concerns a gas burner consisting of a burner pipe, in which gas is supplied and which is provided with a row of linearly arranged perforations that allow the gas through to a burner chamber, and with an ignition mechanism to ignite the gas electrically, whereby the burner pipe is provided on the inside with a gas distribution pipe in order to evenly distribute the gas supply over the entire row of perforations, and whereby the burner chamber is surrounded by a premounted air chamber, which is connected to the burner chamber by means of air slots, whereby these air slots are oblique with respect to the longitudinal axis of the burner pipe at an angle between 10° and 80°, and whereby the air supply through the air slots is controlled by a device that blows in or draws in air through the premounted air chamber.

In addition to the easier ignition at different air speeds and the better combustion at different air speeds, such that the consumption falls, an additional advantage is that the noise level is reduced.

Preferably the perforations in the burner pipe are at a distance of 6 mm to 20 mm apart and have a diameter of 1.5 to 6 mm, and the burner pipe itself is 50 to 100 mm long. The perforations in the gas distribution pipe have a distance between them that La greater than that of the perforations in the burner pipe, but the gas distribution pipe itself is just as long as the burner piper and has a smaller diameter so that the gas distribution pipe can be positioned within the burner pipe.

An advantage of this burner pipe with gas distribution pipe is that the gas supply to the burner pipe is distributed evenly over the entire length of the burner pipe. Moreover the gas distribution pipe ensures an even suction effect on new gas to replace the burned gas.

After the gas supply has been opened an ignition mechanism ensures that the gas-oxygen mixture ignites. The explosion causes an overpressure wave which propagates to the open side of the burner chamber and is finally dissipated into the environment at the open end.

Due to the explosion there is an acceleration of the hot air to the outside, resulting in a suction force on the perforation of the burner pipe. The newly drawn in gas comes into contact with air and then ignites. This process is repeated for as long as there is a supply of gas and is called autopulsation.

This autopulsation occurs in each perforation of the burner pipe, that is only 6 to 20 mm from a subsequent perforation. The gas-oxygen mixture is thus ignited each time by the flame of a neighbouring perforation. The depth of the burner chamber plays a role and ensures that the entire cycle is continually repeated at its natural frequency, such that the burner makes a characteristic humming sound.

The autopulsation causes a suction effect on the gas inlet holes, such that it is possible to operate below a gas pressure of only 10 to 30 mb.

Air slots are provided between the premounted air chamber and the burner chamber in order to ensure the oxygen supply to the burner chamber.

The air slots are between 3 and 12 mm wide, and between 20 and 80 m long, and positioned obliquely with respect to the longitudinal axis of the burner pipe at an angle of between 10° and 80°.

It is these air slots and their positioning that ensure that the gas/oxygen ratio is suitable, at both low and high air speed, for easy ignition and the burner can operate and be ignited within a large range of air speeds.

In an alternative embodiment an air slot can take on the form of a series of holes, placed after one another, of whatever shape such as oval, rectangular or circular holes for example, whose diameter is between 3 mm and 12 mm, whereby each series of holes placed after one another is between 20 mm and 80 mm long, and whereby this list of shapes is not exhaustive.

The chosen size of the air slots or series of holes is determined by:

- the air speed and air pressure;
- the capacity of the burner;
- the dimensions of the air chamber that acts as a blowout chamber or suction chamber.

With the intention of better showing the characteristics of the invention, a preferred embodiment of a gas burner for a strong air flow according to the invention is described hereinafter, by way of an example without any limiting nature, with reference to the accompanying drawings, wherein:

FIG. 1 schematically shows a cross-section of a gas burner according to the invention perpendicular to its longitudinal axis;

Figure 1:
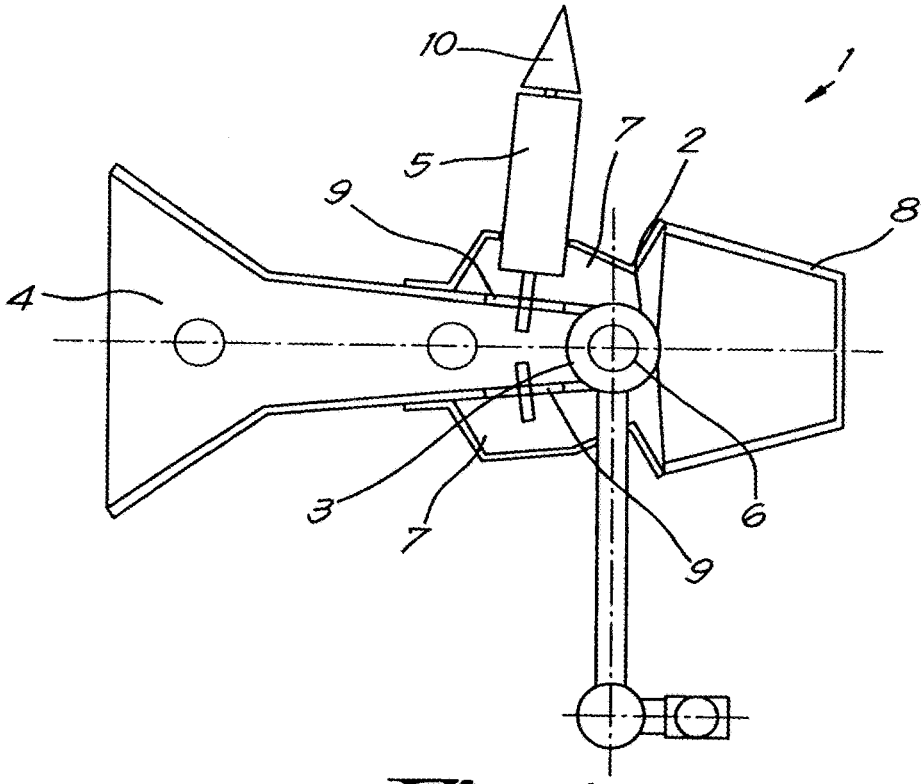

FIG. 1 schematically shows a cross-section of a gas burner 1 for a strong air flow according to the invention. The gas burner consists of a burner pipe 2 that is provided with a row of linearly arranged perforations 3 that allow the gas through to a burner chamber 4 and with an ignition mechanism 5 to ignite the gas, whereby the burner pipe 2 is provided on the inside with a gas distribution pipe 6 to evenly distribute the gas supply over the entire row of perforations 3, and the burner chamber 4 is surrounded by a premounted air chamber 7 that is connected to a screen 8 and which is connected to the burner chamber 4 by means of air slots 9.

Figure 2:
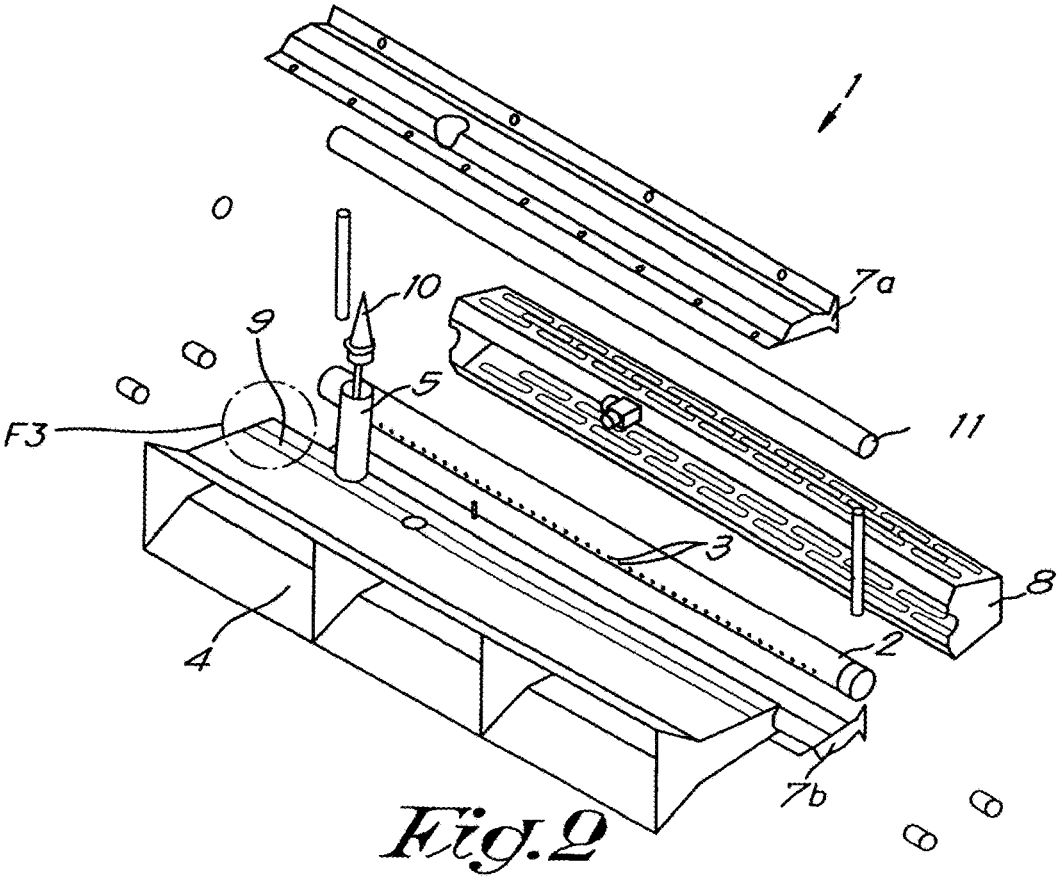
FIG. 2 shows an exploded view in perspective of a gas burner according to the invention.

FIG. 2 shows an exploded, view in perspective of a gas burner according to the invention which the relative position of the burner pipe 2 with perforations 3, the burner chamber 4, the air chamber 7, now split into a top part 7*a* and bottom part 7*b,* can be seen, and the burner chamber 4 is provided with air slots 9 that connect the burner chamber 4 to the air chamber 7. The gas igniter is an electrical ignition with a spark plug 10 that can ignite the gas/air mixture at the level of the air slots 9 at the perforations 3 in the burner pipe. The necessary gas is supplied by a supply pipe 11.

Figure 3:
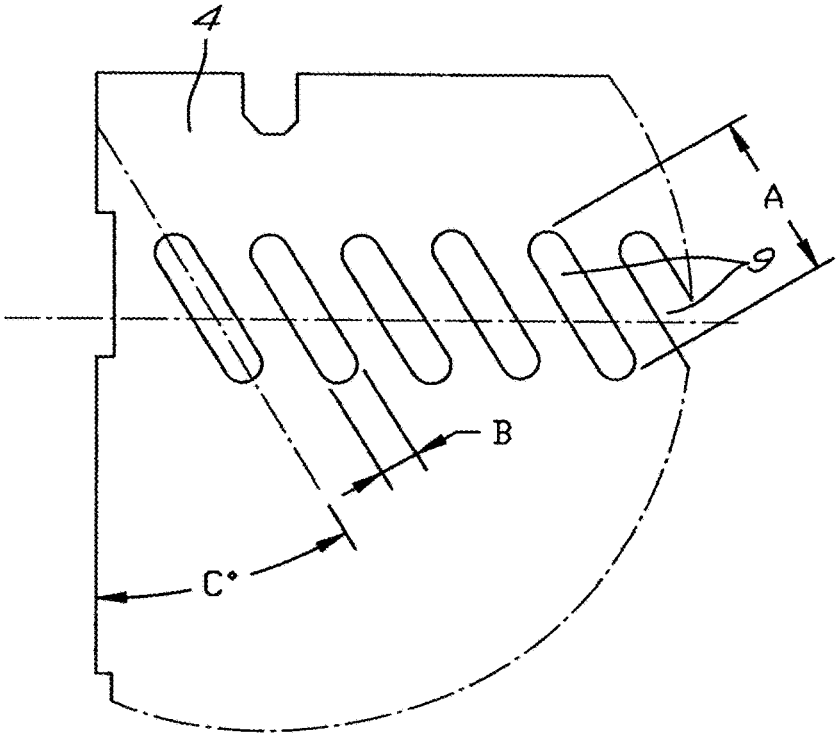
FIG. 3 shows the section indicated by F3 in FIG. 2 on a larger scale.

FIG. 3 shows a detail on a larger scale, indicated by F3 in FIG. 2, in which the air slots 9 can be seen better in one corner of the burner chamber 4, and their oblique position with respect to the longitudinal axis of the burner pine 2, indicated by the angle C can also be seen. The length of one air slot is indicated by the distance A, and its width by the distance B.

Figure 4:
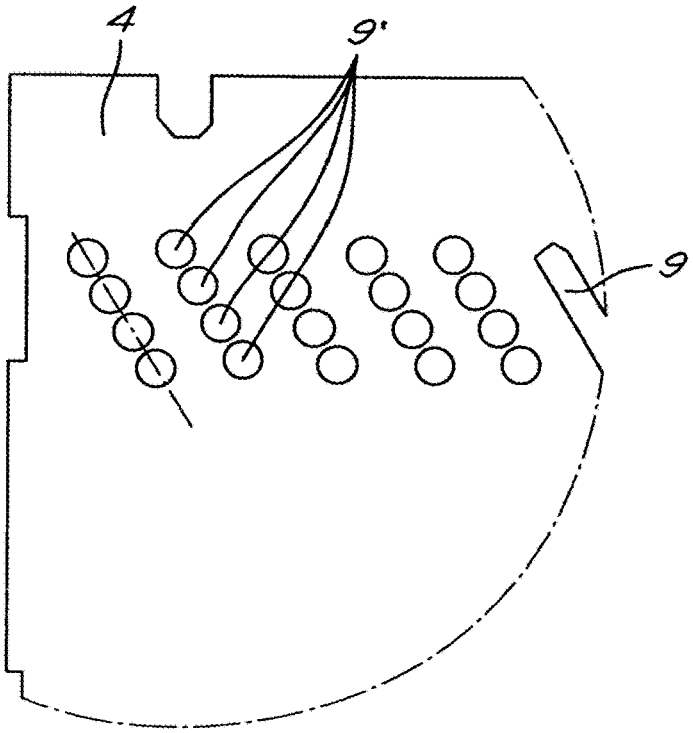
FIG. 4 shows a variant embodiment of FIG. 3.

FIG. 4 shows a variant embodiment of the air slots 9, whereby one air slot 9 is now replaced by a linear series of circular holes 9', in this case four circular holes, distributed over the length of one air slot, and whose diameter corresponds to the width 13 of one air slot 9.

Figure 5:
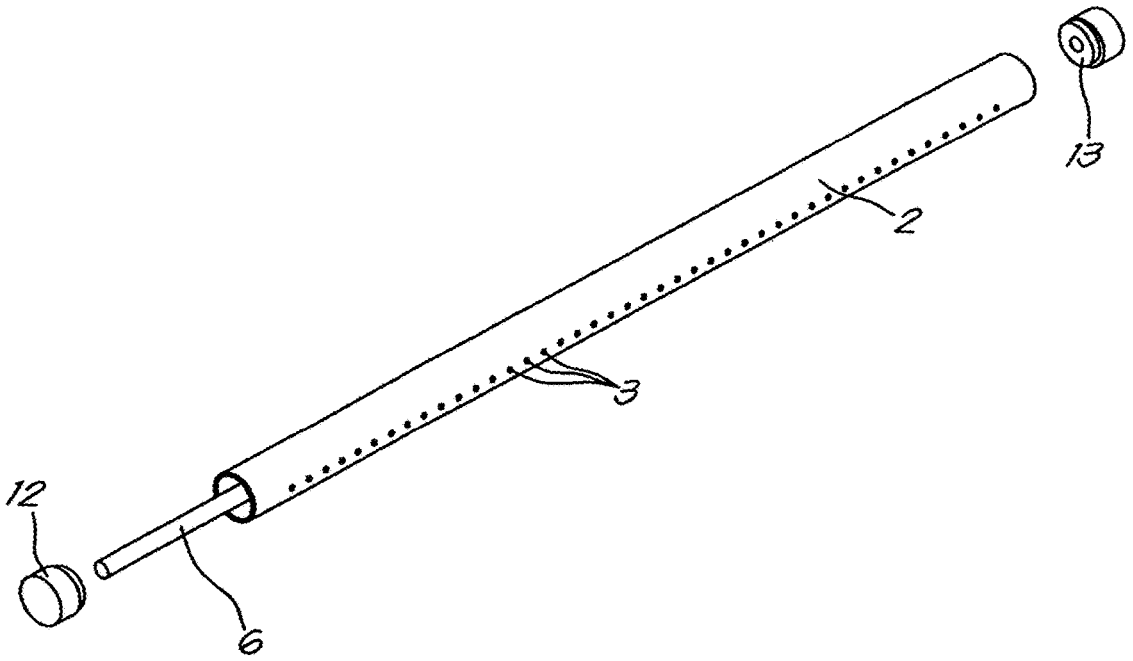
FIG. 5 shows the burner pipe with distribution pipe according to the invention in more detail.

FIG. 5 shows the burner pipe 2 in more detail, with the gas distribution pipe 6 of a smaller diameter slid therein and the end connecting pieces 12, 13 on the burner pipe 2.

Figure 6:
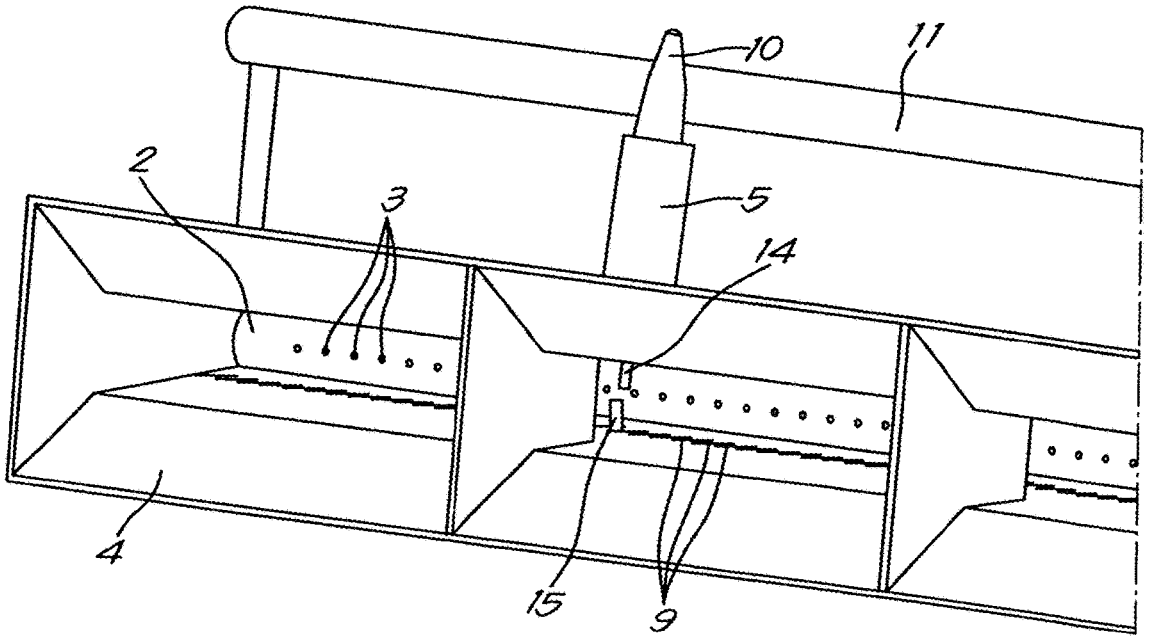
FIG. 6 shows the electrical ignition of the gas burner in the burner chamber in more detail.

FIG. 6 shows the positioning of the igniter 5 with sparkplug 10 in more detail, shown in the burner chamber with its arc contacts 14, 15 at the level of the air slots 9 in the top part and in the bottom part of the burner chamber 4.

The operation of the gas burner 1 according to the invention is very simple and as follows.

The gas burner can be applied for example in hot air heating installations, whereby a heated air flow is directed towards an environment to be heated. To this end a blower installation is used, for example a fan, that drives an air flow at a desired speed through the air chamber 7, from where the air flows through the air slots 9 to the burner chamber 4.

Gas is supplied by a supply pipe 11 to a distribution pipe 6 that is surrounded by a burner pipe 2, and which supplies gas evenly to each of the perforations 3 in the burner pipe along which the gas flows and is mixed with air in the burner chamber 4.

The gas burner can be ignited at every air speed by an electrical igniter 5 with sparkplug 10, that ignites the gas/air mixture at the perforations 3 of the burner pipe 2 using arc contacts 14, 15.

The combustion is initiated by an explosion at a perforation 3 that has a suction effect on the gas distribution pipe 6, and draws in new gas that is exploded by a neighbouring flame so that a system of autopulsation occurs.

The combustion is self-maintaining and can also be maintained with a slight underpressure of the gas or high sir speed for as long as there is a gas supply. Also if the combustion is interrupted, the burner can immediately be ignited, even with a high air speed without having to switch off the fan or stop the suction speed in order to start up the burner again, provided that the air slots that connect the air chamber to the burner chamber are obliquely oriented with respect to the longitudinal axis of the burner pipe 2.

The burner is supplied in a heating installation for combating night frost damage in horticulture, for example.

It goes without saying that such a gas burner can also be used in other applications.

The present invention is by no means limited to the embodiment described as an example and shown ta the drawings, but a gas burner according to the invention can be realised in all kinds of forms and dimensions without departing from the scope of the invention, as described in the following claims.

The invention claimed is:

1. Gas burner (1) consisting of a burner pipe (2), in which gas is supplied and which is provided with a row of linearly arranged perforations (3) that allow the gas through to a burner chamber (4), and with an ignition mechanism (5) to ignite the gas electrically, characterised in that the burner pipe (2) is provided on the inside with a gas distribution pipe (6) in order to evenly distribute the gas supply over the entire row of perforations (3), and that the burner chamber (4) is surrounded by a premounted air chamber (7), which is connected to the burner chamber (4) by means of air slots (9), whereby the air slots (9) are oblique with respect to the longitudinal axis of the burner pipe (2) at an angle between 10° and 80°, and whereby the air supply through the air slots (9) is controlled by a device that blows in or draws in air through the premounted air chamber (7).

2. Gas burner according to claim 1, characterised in that the perforations (3) in the burner pipe (2) are at a distance of 6 mm to 20 mm apart and have a diameter of 1.5 mm to 6 mm, and the burner pipe (2) itself is 50 to 100 mm long.

3. Gas burner according to claim is, characterised in that the gas distribution pipe (6) is just as long as the burner pipe (2), but has a smaller diameter, so that the gas distribution pipe (6) is positioned within the burner pipe.

4. Gas burner according o claim 1, characterised in that the air slots (9) are between 3 mm and 12 mm wide and between 20 and 80 nm long.

5. Gas burner according to claim 4, characterised in that each air slot (9) takes on the form of one series of holes placed after one another of whatever shape (9'), the diameter of which is between 3 mm and 12 mm, and whereby each series of holes (9') placed after one another is between 20 mm and 80 mm long.

6. Gas burner according to claim 1, characterised in that the ignition mechanism (5) comprises an electrical spark plug (10), that is connected by two arc contacts 14, 15 at the level of the air slots 9 in the top part 7*a* and in the bottom part 7*b* of the burner chamber 4 that can ignite the gas/air mixture at the perforations 3 of the burner pipe 2.

* * * * *